US006596090B2

(12) United States Patent
Schmidt

(10) Patent No.: US 6,596,090 B2
(45) Date of Patent: Jul. 22, 2003

(54) METHOD FOR TRANSFERRING FILTER RODS CONTAINING PULVERULENT, GRANULAR AND ANALOGOUS INGREDIENTS

(75) Inventor: Hans-Herbert Schmidt, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/078,227

(22) Filed: Feb. 20, 2002

(65) Prior Publication Data

US 2002/0088479 A1 Jul. 11, 2002

Related U.S. Application Data

(62) Division of application No. 09/534,570, filed on Mar. 27, 2000, now Pat. No. 6,415,474.

(30) Foreign Application Priority Data

Mar. 25, 1999 (DE) ..... 199 13 421

(51) Int. Cl.[7] ..... B08B 5/02

(52) U.S. Cl. ..... 134/15; 134/21; 134/37; 15/309.2; 15/316.1

(58) Field of Search ..... 134/15, 21, 37; 15/309.2, 316.1

(56) References Cited

U.S. PATENT DOCUMENTS

| | | | |
|---|---|---|---|
| 1,575,526 | A | 3/1926 | Bocher |
| 2,367,393 | A | 1/1945 | Green |
| 3,909,873 | A | 10/1975 | Minasov et al. |
| 4,073,029 | A | 2/1978 | Vassallo |
| 4,167,797 | A | 9/1979 | Wilde et al. |
| 5,135,008 | A | 8/1992 | Osterling et al. |
| 5,556,236 | A | 9/1996 | Seim, II et al. |

FOREIGN PATENT DOCUMENTS

| | | |
|---|---|---|
| GB | 1 410 473 | 10/1975 |

*Primary Examiner*—Zeinab El-Arini
(74) *Attorney, Agent, or Firm*—Venable; Robert Kinberg; Chad C. Anderson

(57) ABSTRACT

A method of transporting rod-shaped tobacco smoke filters, which carry solid particles, along an elongated path from a sender to a receiving station, includes transporting the filters from the sender to the receiving station through the predetermined portion of the path. A plurality of jets of a pressurized gaseous fluid is directed across a predetermined portion of the path to expel from the portion of the path solid particles which are separated or separable from the filters. The expelled particles are collected in a chamber outwardly adjacent the predetermined portion of the path. The collected particles are evacuated from the chamber.

12 Claims, 2 Drawing Sheets

METHOD FOR TRANSFERRING FILTER RODS CONTAINING PULVERULENT, GRANULAR AND ANALOGOUS INGREDIENTS

CROSS-REFERENCE TO RELATED CASES

This application is a divisional application of Ser. No. 09/534,570, filed Mar. 27, 2000, now U.S. Pat. No. 6,415,474 which claims the priority of German patent application Serial No. 199 13 421.9 filed Mar. 25, 1999. The disclosure of the above-referenced German patent application, as well as each U.S. and foreign patent and patent application mentioned in the specification of the present application, is incorporated herein by reference.

BACKGROUND OF THE INVENTION

The present invention relates to improvements in methods of and apparatus for transferring rod-shaped commodities which serve to filter tobacco smoke and carry and/or contain pulverulent, granular or otherwise configurated and/or dimensioned ingredients, e.g., particles of charcoal embedded in rod-like fillers of acetate fibers, crepe or the like. More specifically, the invention relates to improvements in methods of and in apparatus for transporting tobacco smoke filtering rods or plugs, which carry confined and/or adherent solid particles, or compel loose particles to advance, along an elongated path from a sender of a file of successive rods to a receiving station.

It is customary to advance a file of successive rod-like filters, normally filters of multiple unit length, along an elongated path which is defined by an elongated pneumatic conveyor in the form of a conduit. If the filters contain and/or carry solid particles, such as granules of charcoal, a certain percentage of solid particles becomes separated from the filters; this results in highly undesirable contamination of the conduit and/or of the parts at the receiving station. Stray particles of charcoal or the like are particularly undesirable at the receiving station because the operation of parts at such station is likely to be adversely affected to a progressively increasing degree unless the apparatus is equipped with suitable means for intercepting stray particles and/or those particles which are likely to become separated from the filters. Attempts to intercept, collect and evacuate solid particles from the path for successive filter rods of a file of such commodities are disclosed, for example, in commonly owned British specification No. 1 410 473 published Oct. 15, 1975 and in U.S. Pat. No. 5,556,236 granted Sep. 17, 1996. The means for admitting granules of charcoal and/or other solid particles can include so-called AC machines (distributed by the assignee of the present application) which sprinkle solid particles onto a running tow of filter material (e.g., acetate fibers).

OBJECTS OF THE INVENTION

An object of the invention is to provide a novel and improved apparatus which can gather and evacuate stray solid particles and/or readily separable solid particles from the path for filter rods for tobacco smoke with a degree of efficiency and reliability exceeding that of heretofore known apparatus.

Another object of the invention is to provide a novel and improved apparatus whose operation is not affected by the rate of delivery of filter rods from a sender to a receiving station.

A further object of the invention is to provide an apparatus which can reliably intercept, gather and dispose of stray solid particles ahead of the station which receives successive filter rods of a file of such commodities and which accommodates devices likely to be adversely affected by stray particles of charcoal or the like.

An additional object of the invention is to provide an apparatus which can intercept and evacuate high percentages of or all solid particles from the path for filter rods of unit or multiple unit length without affecting the quality (such as the configuration) of filter rods.

Still another object of the invention is to provide a novel and improved method of evacuating solid particles (such as granules of charcoal or dust of charcoal and/or other solid additives which enhance the filtering action of the filter rods and/or the flavor of tobacco smoke) from the path for advancement of a series of successive filter rods from a sender (e.g., a filter rod making machine) to a receiving station, e.g., a station which gathers filter rods preparatory to admission into the magazine of a filter tipping machine.

SUMMARY OF THE INVENTION

The invention is embodied in an apparatus for transporting tobacco smoke filtering rods (e.g., filter rod sections of twice, four times or six times unit length), which carry solid particles (such as fragments of charcoal) along an elongated path extending from a sender to a receiving station. The improved apparatus comprises a pneumatic conveyor which defines at least a portion of the elongated path and includes a section provided with openings serving to establish communication between the aforementioned portion of the path and a collecting chamber, and means for propelling (by way of the openings) at least some of the solid particles which become separated from the filtering rods not later than in the aforementioned portion of the path.

The conveyor preferably includes an elongated conduit and the openings can constitute slots provided in the conduit in the aforementioned portion of the path; such slots can extend at least substantially radially of the conduit.

The propelling means can comprise a source of pressurized gaseous fluid (e.g., compressed air) and means for directing gaseous fluid furnished by the source into the conveyor in the regions of the openings.

The conduit of the pneumatic conveyor can include a series of successive annular components which define the aforementioned portion of the path; the openings are then disposed between the successive annular components of the conduit and preferably constitute circumferentially complete slots.

The means for propelling pressurized gaseous fluid from the aforementioned source into the conveyor in the regions of the openings can comprise a pipe or duct receiving pressurized fluid from the source and extending along the aforementioned portion of the path; such duct has outlets (e.g., in the form of orifices or ports) serving to direct jets of pressurized fluid toward at least some of the openings. The duct is preferably closely adjacent to and can serve as a support for the collecting chamber and/or for the aforementioned annular components of the conduit.

The aforementioned portion of the path is or can be at least substantially vertical, and the conveyor is preferably arranged to convey the rods downwardly at least in the at least substantially vertical portion of the path. The particle-collecting chamber of such apparatus is or can be designed and mouted in such a way that it includes an upper portion above and a lower portion below the openings, and an outlet (such as a tubular extension of the lower portion) for collected particles. The chamber can at least partially surround the conveyor in the region of the aforementioned portion of the path.

Another feature of the invention resides in the provision of a method of transporting rod-shaped tobacco smoke filters, which carry solid particles along an elongated path from a sender to a receiving station. The method comprises the steps of directing into a predetermined portion of the path a plurality of jets of a pressurized gaseous fluid to thus expel from such predetermined portion of the path solid particles which are separated and/or separable from the filters, collecting the expelled particles in a chamber which is outwardly adjacent the predetermined portion of the path, and evacuating collected particles from the chamber.

The predetermined portion of the path is or can be at least substantially vertical, and the method can further comprise the step of conveying the filters downwardly into and through the predetermined portion of the path.

The evacuating step can include discharging collected particles from the chamber by gravity flow.

Still further, the method can comprise the step of braking successive filters downstream of the predetermined portion of the path.

The particles can include or constitute fragments of charcoal.

The method can also include the step of establishing a plurality of openings (e.g., in the form of arcuate or annular slots) for the expulsion of solid particles from the predetermined portion of the path into the chamber.

The pressurized fluid is or can be compressed air.

Still further, the method can comprise the step of changing the orientation of filters between the predetermined portion of the path and the receiving station.

The novel features which are considered as characteristic of the invention are set forth in particular in the appended claims. The improved apparatus itself, however, both as to its construction and the modes of assembling and operating the same, together with numerous additional is important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
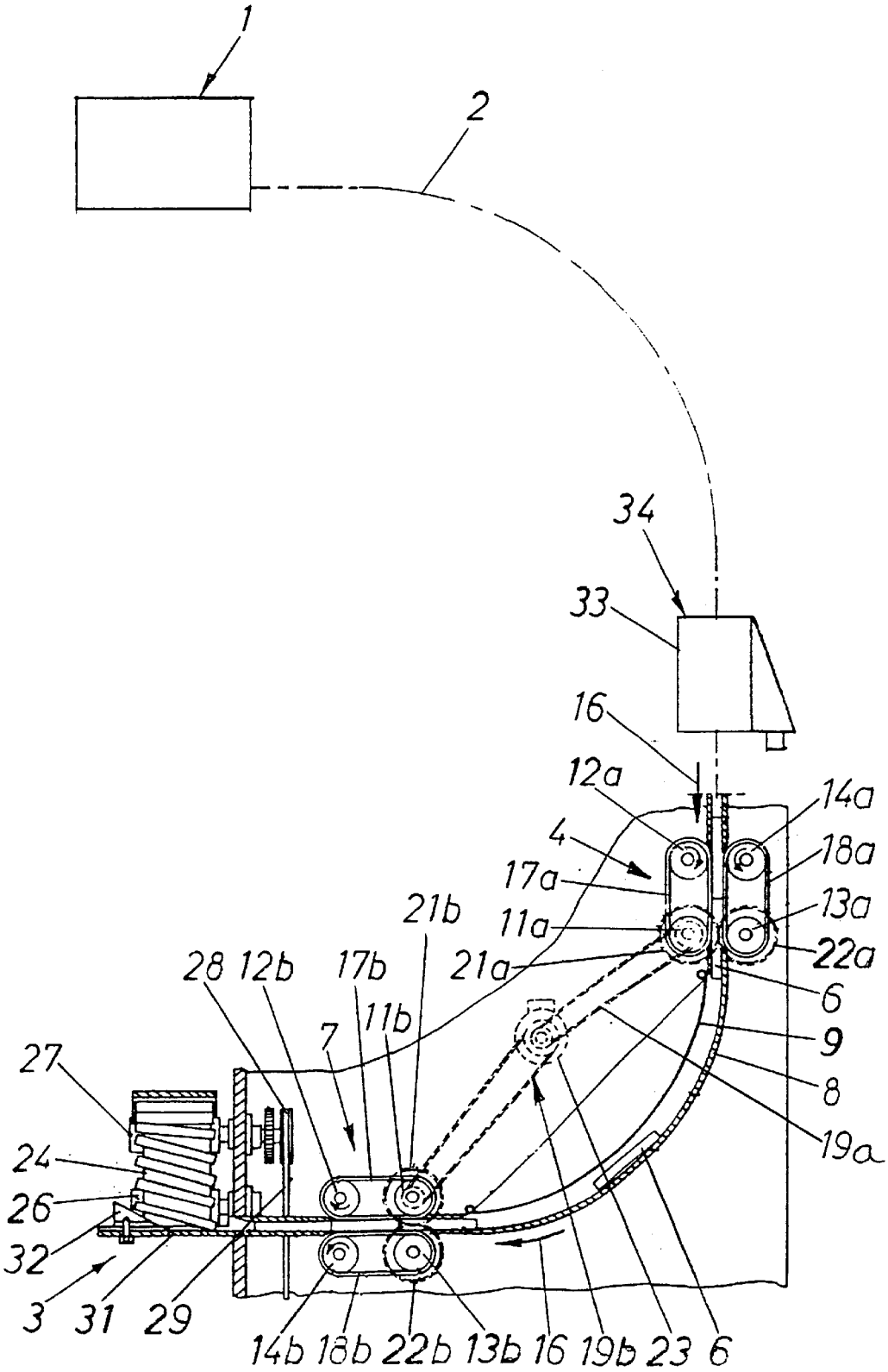
FIG. 1 is a partly schematic elevational view of an apparatus which embodies one form of the present invention, certain parts at the receiving station being shown in a vertical sectional view.

Referring first to FIG. 1, there is shown an apparatus which comprises a sender 1 of a file of successive rod-shaped filters 6, a pneumatic conveyor including an elongated conduit 2 defining an elongated path for the file of filters 6, and a receiving station 3 for temporary storage and/or other treatment (such as changing the orientation) of successive filters. The station 3 accommodates or follows a braking or decelerating device 4 which reduces the speed of successive filters 6 being delivered by the conduit 2, and an accelerating device 7 which follows the braking device 4 and serves to accelerate successive filters 6 ahead of an orientation and direction changing unit including two endless belts or bands 24 (only one shown in FIG. 1).

The apparatus of FIG. 1 can constitute a modified version of the apparatus known as FILTROMAT and distributed by the assignee of the present application. For example, the so-called FILTROMAT 3 can be set up to deliver up to and even in excess of 2500 tobacco smoke filters per minute and, can manipulate acetate, crepe, charcoal and dual filters; furthermore, such apparatus are or can be equipped with automatic cleaning means and with a facility for automatic detection and removal of defective rod-shaped filters.

Referring again to FIG. 1, a portion of the elongated path between the braking device 4 and the accelerating device 7 is defined by an elongated arcuate guide 8 having a cross-sectional outline which is at least substantially U-shaped and an open upper side which is overlapped by a flexible resilient cover 9 of sheet metal or the like. An advantage of such guide is that it can change the direction of movement of successive rod-shaped filters 6 from vertically downwardly (see the upper arrow 16) to horizontally (see the lower arrow 16) within a small area and without affecting the condition (such as the shape) of successive filters.

The braking unit 4 upstream of the guide 8 comprises upstream pulleys 12*a*, 14*a* and downstream pulleys 11*a*, 13*a*, a first endless belt or band 17*a* which is trained over the pulleys 11*a*, 12*a*, and a second endless belt or band 18*a* trained over the pulleys 13*a*, 14*a*. The confronting vertical inner stretches or reaches of the belts 17*a*, 18*a* engage and decelerate successive filters 6 which are delivered by the pneumatic conveyor including the conduit 2. The distances between the pulleys 11*a*, 13*a* and the associated pulleys 12*a*, 14*a* (i.e., the lengths of the confronting inner reaches of the belts 17*a*, 18*a*) are selected in such a way that these belts can reliably engage and decelerate but do not affect the shapes and/or other desirable characteristics of the oncoming filters 6.

The construction of the accelerating device 7 is analogous to (and can be identical with) that of the braking device 4, and its parts are denoted by similar reference numerals except that the characters a are replaced with characters b. The difference between the devices 4 and 7 is that the belts or bands 17*b*, 18*b* of the device 7 serve to accelerate the oncoming filters before such filters reach the endless belts 24. The means for driving the pulleys 11*a*–14*a* at a relatively low speed comprises a prime mover 23 (e.g., an electric motor) and a transmission including a chain or toothed belt 19*a* and sprocket wheels or toothed pulleys 21*a*, 22*a* coaxial with the pulleys 11*a*, 13*a*, respectively. The means for driving the pulleys 11*b*–14*b* at a relatively high speed comprises the motor 23 (or a discrete second prime mover) and a second transmission including a chain or a toothed belt 19*b* and sprocket wheels or toothed pulleys 21*b*, 22*b* coaxial with the pulleys 11*b*, 13*b*, respectively. The belts 17*a*, 18*a* serve to transmit torque from the pulleys 11*a*, 13*a* to the associated pulleys 12*a*, 14*a*, and the belts 17*b*, 18*b* serve to transmit torque from the pulleys 11*b*, 13*b* to the associated pulleys 12*b*, 14*b*. As already mentioned above, the belts 17*a*, 18*a* of the braking device 4 serve to decelerate the filters 6 descending in the conduit 2, and the belts 17*b*, 18*b* of the device 7 serve to accelerate the filters arriving from the device 4 along the guide 8.

The endless belts 24 at the receiving station 3 are trained over pairs of pulleys 26, 27 (only one of these pairs can be seen in FIG. 1). The purpose of the belts 24 is to advance successive oncoming (accelerated) filters 6 sideways (upwardly) into a magazine or reservoir (not shown), e.g., into the magazine of a filter tipping machine (such as a machine known as MAX and distributed by the assignee of the present application) wherein the filters are assembled with plain-cigarettes, cigars or cigarillos to form filter-tipped smokers' products. A MAX-type filter tipping machine is described, for example, in commonly owned U.S. Pat. No. 5,135,008 granted Aug. 4, 1992.

The pulleys 27 for the belts 24 are driven by a prime mover (not shown) through the intermediary of a transmission including an endless toothed belt or chain 29 and a toothed pulley or sprocket wheel 28.

A horizontal guide 31 is provided at the receiving station 3 to steer successive accelerated filters 6 from the device 7 against a wedge-like deflector 32 serving to raise the leaders of successive filters 6 into contact with the confronting reaches of the endless belts 24 so that such belts can move the filters sideways and upwardly into the aforementioned magazine of the filter tipping machine.

In accordance with a feature of the present invention, a section 34 of the conduit 2 upstream of the braking device 4 (i.e., upstream of the receiving station 3) cooperates with a unit which serves to propel any loose solid particles 43 (see FIG. 2) which continue to adhere to the external surfaces of the filters 6 and/or which are already separated from the filters into a collecting chamber 33. The latter can at least partially surround the section 34 and its lower portion has an outlet 42 for evacuation (e.g., by gravity flow) of collected solid particles 43 into a bin or the like, not shown.

The illustrated section 34 of the conduit 2 is a separately produced assembly of vertically aligned annular components 37 which are at least partially separated from each other by openings 36 in the form of arcuate or circumferentially complete radially extending annular slots 36. The propelling device which serves to expel loose solid particles 43 from the section 34 of the conduit 2 into the chamber 33 comprises a source 41 of pressurized gaseous fluid (e.g., compressed air), a duct 39 which serves to guide a stream of pressurized fluid upwardly and along the section 34, and outlets 38 in the form of radial orifices provided in the duct 39 to direct jets of pressurized fluid into and across the section 34 by way of the adjacent openings or slots 36. This results in the expulsion of loose solid particles 43 from the section 34 and into the collecting chamber 33. The duct 39 can serve as a carrier for the annular components 37 of the section 34 and/or for the collecting chamber 33.

The source 41 can include an air compressor or an accumulator (not shown).

The operation of the improved apparatus is as follows:

When the apparatus is in use, the sender 1 supplies a file of successive filters 6 into the conduit 2 wherein the filters advance lengthwise toward the receiving station 3. During such travel, successive filters 6 advance through the section 34 of the conduit 2 before they enter the braking device 4. The source 41 supplies pressurized pneumatic fluid into the duct 39 which causes the outlets is or orifices 38 to discharge jets of pressurized fluid into the neighboring slots 36. Such jets expel stray solid particles, as well as those solid particles which are readily separable from the descending filters 6, from the section 34 of the conduit 2 and into the collecting chamber 33. The particles 43 which are expelled from the section 34 impinge upon the confronting walls of the chamber 33 and descend toward and into the outlet 42. The top portion of the chamber 33 is located above the uppermost opening 36, and the bottom portion of the chamber (together with the outlet 42) is located beneath the lowermost opening 36 of the illustrated section 34.

The filters 6 which descend beyond the section 34 of the conduit 2 are force-lockingly engaged and decelerated by the belts 17*a*, 18*a* of the braking device 4. Such filters are devoid of loosely adhering solid particles 43. Braking of the filters 6 by the device 4 results in the accumulation of a column of superimposed filters above the belts 17*a*, 18*a*. Such column rests upon and exerts a considerable downwardly oriented force upon the filter 6 which happens to be engaged and braked by the belts 17*a*, 18*a*. However, and since the lengths of the confronting inner reaches of the belts 17*a*, 18*a* are selected with a view to force-lockingly engage at least a major portion of a filter 6 advancing through the braking device 4 and actually supporting a column of superimposed filters, such filter can be properly decelerated by the belts 17*a*, 18*a* without undergoing any, or any appreciable, deformation.

It is often sufficient to utilize a braking device wherein the length of the confronting inner reaches of the belts 17*a*, 18*a* is less (even considerably less) than or exceeds the length of a filter, depending for example upon the length and weight of the filters supplied by the sender 1.

Successive filters 6 which advance downwardly beyond the braking device 4 enter and slide along the arcuate guide 8 on their way toward and into the accelerating device 7. The confronting inner reaches of the belts 17*b*, 18*b* engage and accelerate successive filters 6 in a direction toward the deflector 32. Such acceleration ensures that the filters 6 advancing along the guide 31 are out of contact with the neighboring (preceding and next-following) filters so that a filter which is deflected at 32 is not interfered with by the next-following filter. The belts 24 transport successive filters 6 sideways and upwardly into the aforementioned magazine or to any other selected destination.

Figure 2:
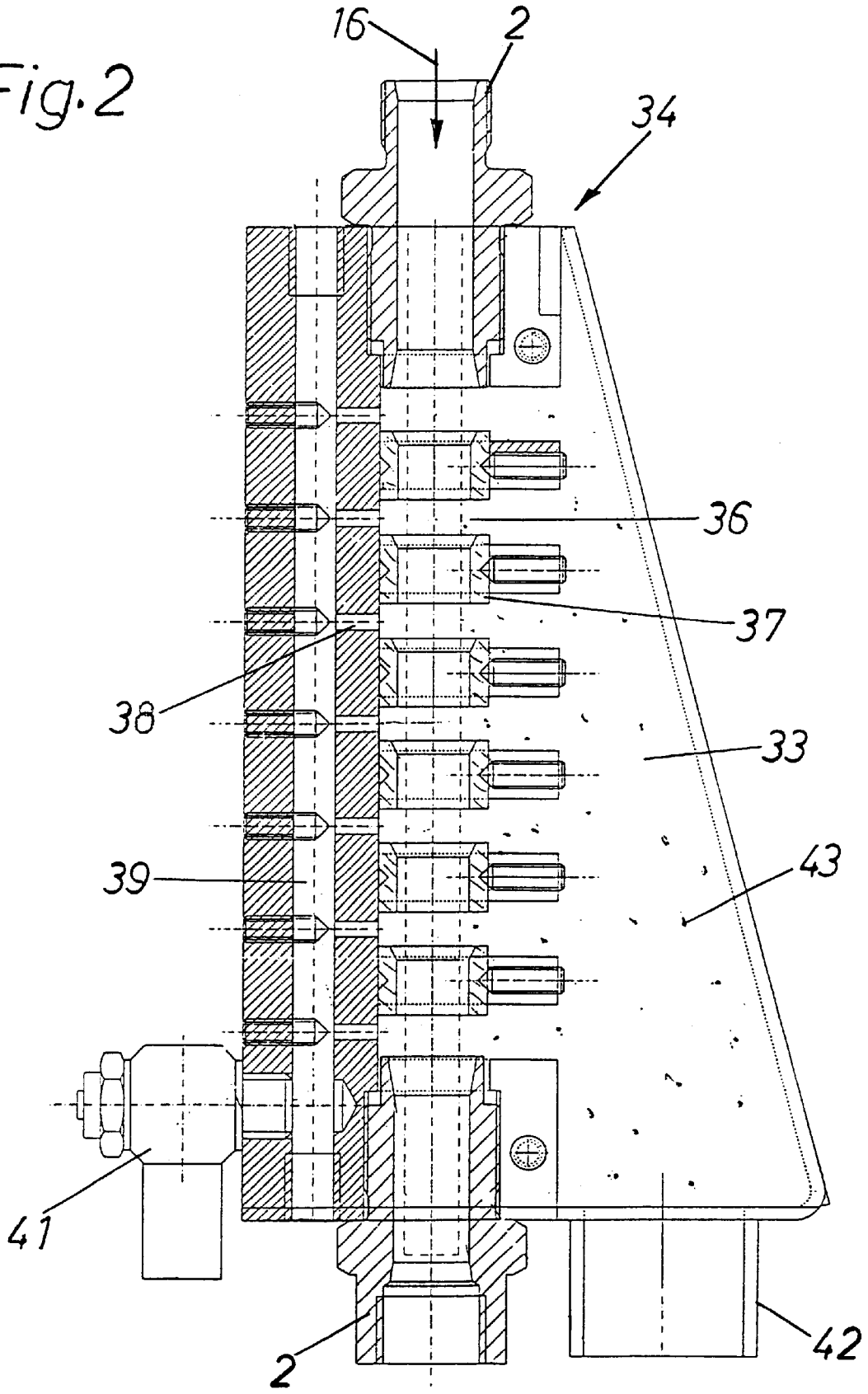
FIG. 2 is a greatly enlarged partly sectional view of a section of the pneumatic conveyor, of the particle collecting chamber and of the means for propelling solid particles into the collecting chamber.

An important advantage of the improved method and apparatus is that the structure which is shown in FIG. 2 (or an equivalent thereof) is capable of relieving the interior of the section 34 of the conduit 2 and the filters 6 advancing toward the braking device 4 of loose solid particles 43 when the filters descend into the section 34 at a relatively low or at a higher or much higher speed. This greatly reduces the likelihood of undesirable stoppages for the purpose of cleaning the braking device 4, the guide 8 and/or the accelerating device 7.

Another advantage of the improved method and apparatus is that the interior of the collecting chamber 33 need not be maintained at an elevated pressure because the particles 43 which are in the process of entering or have already entered this chamber can be evacuated automatically, i.e., by gravity feed.

A further advantage of the improved method and apparatus is that the expulsion of solid particles from the path leading from the sender 1 to the receiving station 3 can be effected in a surprisingly short portion (section 34) of the conduit 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of transporting filter rods and, therefore, such adaptations should and are intended to be comprehended within the meaning and range of equivalence of the appended claims.

What is claimed is:

1. A method of transporting rod-shaped tobacco smoke filters, which carry solid particles, along an elongated path from a sender to a receiving station, comprising the steps of:

transporting the filters from the sender to the receiving station through the predetermined portion of the path;

directing across the predetermined portion of the path a plurality of jets of a pressurized gaseous fluid to expel from said portion of the path solid particles which are separated or separable from the filters;

collecting the expelled particles in a chamber outwardly adjacent the predetermined portion of the path; and evacuating collected particles from the chamber.

2. The method of claim 1, wherein said portion of the path is at least substantially vertical, and further comprising the step of conveying the filters downwardly into and through said portion of the path.

3. The method of claim 1, wherein said evacuating step includes discharging collected particles from the chamber by gravity flow.

4. The method of claim 1, further comprising the step of braking successive filters downstream of said predetermined portion of the path.

5. The method of claim 1, wherein the particles include fragments of charcoal.

6. The method of claim 1, further comprising the step of establishing a plurality of openings for the expulsion of solid particles from said predetermined portion of the path into the chamber.

7. The method of claim 1, wherein the pressurized fluid is compressed air.

8. The method of claim 1, wherein the filters have an orientation in the predetermined portion of the path, and wherein the method further comprises the step of changing the orientation of filters between said predetermined portion of the path and the receiving station.

9. The method of claim 1, wherein the directing step includes directing the plurality of jets of the pressurized gaseous fluid through one side of the predetermined portion of the path and through another side of the predetermined portion of the path.

10. A method of transporting rod-shaped tobacco smoke filters, which carry solid particles, along an elongated path from a sender to a receiving station, comprising the steps of:

transporting the filters from the sender to the receiving station through a predetermined portion of the path;

directing across the predetermined portion of the path a plurality of jets of a pressurized gaseous fluid to expel from said portion of the path solid particles which are separated or separable from the filters;

collecting the expelled particles in a chamber outwardly adjacent the predetermined portion of the path;

evacuating collected particles from the chamber; and braking successive filters downstream of said predetermined portion of the path.

11. A method of transporting rod-shaped tobacco smoke filters, which carry solid particles, along an elongated path from a sender to a receiving station, comprising the steps of:

transporting the filters from the sender to the receiving station through a predetermined portion of the path;

directing across the predetermined portion of the path a plurality of jets of a pressurized gaseous fluid to expel from said portion of the path solid particles which are separated or separable from the filters;

collecting the expelled particles in a chamber outwardly adjacent the predetermined portion of the path;

evacuating collected particles from the chamber; and establishing a plurality of opening for the expulsion of solid particles from said predetermined portion of the path into the chamber.

12. A method of transporting rod-shaped tobacco smoke filters, which carry solid particles, along an elongated path from a sender to a receiving station, where the filters have an orentation in a preferermined portion of the path, comprising the steps of:

transporting the filters from the sender to the receiving station through the predetermined portion of the path;

directing across the predetermined portion of the path a plurality of jets of a pressurized gaseous fluid to expel from said portion of the path solid particles which are separated or separable from the filters;

collecting the expelled particles in a chamber outwardly adjacent the predetermined portion of the path; and evacuating collected particles from the chamber; and changing the orientation of filter between said predetermined portion of the path and the receiving station.

* * * * *